US006256468B1

(12) United States Patent
Liu

(10) Patent No.: US 6,256,468 B1
(45) Date of Patent: Jul. 3, 2001

(54) TONER CAKE DELIVERY SYSTEM HAVING A CARRIER FLUID SEPARATION SURFACE

(75) Inventor: Chu-heng Liu, Penfield, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/525,344

(22) Filed: Mar. 13, 2000

(51) Int. Cl.[7] ..... G03G 15/10

(52) U.S. Cl. ..... 399/237; 399/130; 399/133; 430/117

(58) Field of Search ..... 399/133, 130, 399/237, 239, 240, 154; 430/117, 126

(56) References Cited

U.S. PATENT DOCUMENTS

| | | | |
|---|---|---|---|
| 3,729,419 | 4/1973 | Honjo et al. | 430/115 |
| 3,841,893 | 10/1974 | Honjo et al. | 430/119 |
| 3,847,478 | 11/1974 | Young | 399/309 |
| 3,968,044 | 7/1976 | Tamai et al. | 430/106 |
| 4,476,210 | 10/1984 | Croucher et al. | 430/114 |
| 4,504,138 | 3/1985 | Kuehnle et al. | 399/240 |
| 4,707,429 | 11/1987 | Trout | 430/115 |
| 4,762,764 | 8/1988 | Ng et al. | 430/115 |
| 4,794,651 | 12/1988 | Landa et al. | 430/110 |
| 5,223,368 | 6/1993 | Ciccarelli et al. | 430/110 |
| 5,436,706 | 7/1995 | Landa et al. | 399/238 |
| 5,451,483 | 9/1995 | Fuller et al. | 430/114 |
| 5,484,670 | 1/1996 | Angell et al. | 429/199 |
| 5,519,473 | 5/1996 | Morehouse, Jr. et al. | 399/239 |
| 5,596,396 | 1/1997 | Landa et al. | 399/237 |
| 5,610,694 | 3/1997 | Lior et al. | 399/240 |
| 5,619,313 | 4/1997 | Domoto et al. | 399/233 |
| 5,826,147 | 10/1998 | Liu et al. | 399/237 |
| 5,937,243 | 8/1999 | Liu et al. | 399/130 |
| 5,966,570 | 10/1999 | Till et al. | 399/133 |
| 5,991,582 * | 11/1999 | Liu et al. | 399/237 |
| 6,052,550 * | 4/2000 | Thornton et al. | 399/237 |
| 6,122,471 * | 9/2000 | Liu et al. | 399/237 |

FOREIGN PATENT DOCUMENTS

| | | |
|---|---|---|
| 11-202631 * | 7/1999 | (JP) . |
| 11-223997 * | 8/1999 | (JP) . |

* cited by examiner

*Primary Examiner*—Sophia S. Chen
(74) *Attorney, Agent, or Firm*—Mark Z. Dudley

(57) ABSTRACT

An imaging system for effecting electrostatic printing of an image, wherein the imaging system includes at least one contact electrostatic printing engine operable in a novel fashion upon a copy substrate, for imaging and development of a latent image representative of the image, and subsequent transfer of the developed image to the copy substrate. The developed image is created by separating and selectively transferring portions of a high solids content toner cake layer in correspondence with the image and non-image regions of the latent image. A toner cake layer delivery apparatus draws from a supply of low solids content liquid developing material to apply a layer of the liquid developing material onto a carrier fluid separation (CFS) surface of a coating member. Rapid migration of the carrier fluid into the CFS surface causes a substantial reduction of the ratio of carrier fluid to toner solids, thus providing the desired high solids content toner cake layer.

36 Claims, 8 Drawing Sheets

TONER CAKE DELIVERY SYSTEM HAVING A CARRIER FLUID SEPARATION SURFACE

CROSS-REFERENCE TO RELATED APPLICATION

This application is related to U.S. patent application Ser. No. 09/457,456, entitled METHOD AND APPARATUS FOR DELIVERY OF HIGH SOLIDS CONTENT TONER CAKE IN A CONTACT ELECTROSTATIC PRINTING SYSTEM, filed on Dec. 8, 1999, now U.S. Pat. No. 6,122,471, in the names of Chu-heng Liu, Weizhong Zhao, and Paul W. Morehouse, Jr.

FIELD OF THE INVENTION

This invention relates generally to electrostatic latent image development systems that operate using liquid developing material, and, more particularly, relates to a system for electrostatic development of a latent image, wherein the latent image is developed with use of a toner cake layer having a high solids content toner.

BACKGROUND OF THE INVENTION

Various methods of developing a latent image have been described in the art of electrophotographic printing and copying systems. A typical electrostatographic printing process includes a development step whereby a quantity of developing material is physically transported into the vicinity of a latent image bearing imaging member, with the marking material (described herein as toner) in the developing material are caused to migrate via, e.g., electrical attraction, to the image areas of the latent image so as to selectively adhere to the imaging member in an image-wise configuration.

Of particular interest with respect to the present invention is the concept of forming a thin layer of liquid developing material on a first surface of a first member, wherein the layer has a high concentration of charged toner. The layer on the first member is brought into contact with an electrostatic latent image on a second surface of a second member, wherein development of the latent image occurs upon separation of the first and second surfaces, as a function of the electric field strength generated by the latent image. In this process, toner particle migration or electrophoresis is replaced by direct surface-to-surface transfer of a toner layer induced by image-wise fields.

For the purposes of the present description, the concept of latent image development via direct surface-to-surface transfer of a toner layer via image-wise fields will be identified generally as contact electrostatic printing (CEP). Exemplary patents which may describe certain general aspects of contact electrostatic printing, as well as specific apparatus therefor, may be found in U.S. Pat. Nos. 4,504,138; 5,436,706; 5,596,396; 5,610,694; and 5,619,313.

It is desirable that the aforementioned layer of liquid developing material be provided in a very thin and uniform layer that exhibits a high proportion of solids, that is, having a high solids content. Even more desirable is such a layer exhibiting the following advantageous characteristics: a selectable, uniform thickness, preferably in the range of 3–10 microns; a high solids content, preferably in the range of 15 to 35 percent solids; and an accurately metered mass per unit area on the order of 0.1 mg per $cm^2$.

The intuitive and conventional approach is to attempt the formation of such a layer by direct application of liquid developing material having a high solids content. However, due to the very complicated rheological behavior of a liquid developing material having the requisite high solids content, such direct application of a supply of such liquid developing material to a receiving member typically does not achieve a layer having the aforementioned desirable characteristics. For example, the resulting layer has been found to exhibit a variable thickness and a non-uniform mass per unit area, which renders the layer generally unsuitable for most contact electrostatic printing applications.

SUMMARY OF THE INVENTION

In accordance with one aspect of the present invention, there is provided an imaging system for effecting electrostatic printing of an image, wherein the imaging system includes at least one contact electrostatic printing engine operable in a novel fashion upon a copy substrate, wherein each contact electrostatic printing engine images and develops an electrostatic latent image representative of the image, and subsequently transfers the developed image to the copy substrate.

In accordance with another aspect of the present invention, a toner cake delivery apparatus may be constructed and operated in accordance with the contact electrostatic printing process to which the present invention is directed, wherein a toner cake layer of high solids content is created. The toner cake layer may, after delivery to a suitable receiving member, be brought into pressure contact with the surface of a latent image bearing imaging member such that a developed image is created by separating and selectively transferring portions of the toner cake layer in correspondence with the image and non-image regions of the latent image. The toner cake layer is generally characterized as having a high solids content (e.g., approximately 10–50 percent solids, and preferably in the range of approximately 15 to 35 percent solids, or greater), and exhibits the additional advantageous characteristics of a uniform thickness, in the range of 1–15 microns, and an accurately metered mass per unit area on the order of 0.1 mg per $cm^2$.

The toner cake delivery apparatus of the present invention includes a supply of low solids content liquid developing material generally made up of toner particles immersed in a liquid carrier material and also typically including a charge director for providing a mechanism for producing an electrochemical reaction in the liquid developing material composition which generates the desired electrical charge on the toner particles. A low solids content liquid developing material applicator provides a relatively uniform layer of low solids content liquid developing material onto a carrier fluid separation (CFS) surface on a coating member. The layer of low solids content liquid developing material applied to the CFS surface is subject to a rapid migration of at least a portion of the carrier fluid into the coating member and away from the exterior of the CFS surface. As a result, a reduction of the ratio of carrier fluid to toner solids in the outermost portions of the liquid developing material layer results in the formation of the desired toner cake layer. The toner cake layer is then available for transfer to the surface of a receiving member for subsequent use in development of an electrostatic latent image.

In accordance with another aspect of the present invention, a first embodiment of a novel contact electrostatic printing engine may be constructed for imaging and development of a latent image, wherein the contact electrostatic printing engine includes a photosensitive imaging member which is rotated so as to transport the surface thereof in a process direction for implementing steps for charging and imagewise exposure of a light image corresponding to the desired component image. A second movable member in the form of an applicator is provided in combination with a toner cake delivery apparatus, the latter including a supply of low solids content liquid developing material. The toner cake layer delivery apparatus includes a third movable member in the form of the coating member, the supply of low solids content liquid developing material, and a low solids content liquid developing material applicator. After the toner cake layer is formed on the surface of the coating member and transferred to the applicator, the toner cake layer may be brought into pressure contact with the latent image bearing surface of the imaging member by transporting the toner cake layer through a process nip formed by the operative engagement of the applicator and the imaging member. A development step then occurs, producing a developed image made up of selectively separated portions of the toner cake layer on the surface of the applicator, while leaving background image byproduct on the surface of the imaging member. Transfer of the developed image from the surface of the applicator may then be accomplished. Accordingly, apparatus for high-temperature and pressure transfer and/or transfixing may be advantageously employed for carrying out an image transfer step, which would be more difficult to achieve at the photoconductive surface of the imaging member.

In accordance with another aspect of the present invention, the contact electrostatic printing engine provides a process nip formed by operative engagement of the first and second movable members for positioning the toner cake layer in pressure contact with the electrostatic latent image. Imagewise electric fields across the layer of toner cake are generated in the process nip. The process nip is defined by a nip entrance and a nip exit, wherein the process nip and the nip entrance are operative to apply compressive stress forces on the layer of toner cake thereat, and the nip exit is operative to apply tensile stress forces to the layer of toner cake, causing imagewise separation of the layer of toner cake corresponding to the electrostatic latent image. The layer of toner cake is defined by a yield stress threshold in a range sufficient to allow the layer of toner cake to behave substantially as a solid at the nip entrance and in the nip, while allowing the layer of toner cake along the image-background boundary to behave substantially as a liquid at the nip exit.

In accordance with another aspect of the present invention, a second embodiment of a contact electrostatic printing engine may be constructed to include an imaging member for receiving an electrostatic latent image. The imaging member includes a surface capable of supporting the aforementioned toner cake layer. An imagewise exposure device is also provided for generating the electrostatic latent image on the imaging member, wherein the electrostatic latent image includes image areas defined by a first charge voltage and non-image areas defined by a second charge voltage distinguishable from the first charge voltage. The aforementioned toner cake delivery apparatus is provided for depositing the toner cake layer on the surface of the imaging member so as to form a layer of high solids content that is adjacent the electrostatic latent image on the imaging member. In addition, a charge source is provided for selectively delivering charges to the toner cake layer in an image-wise manner responsive to the electrostatic latent image on the imaging member to form a secondary latent image in the toner cake layer, having image and non-image areas corresponding to the electrostatic latent image on the imaging member. A separator member is also provided for selectively separating portions of the toner cake layer in accordance with the secondary latent image to create a developed image corresponding to the secondary electrostatic latent image formed on the imaging member.

In accordance with another aspect of the present invention, a third embodiment of a contact electrostatic printing engine may be constructed to include an imaging member for receiving an electrostatic latent image. The imaging member includes a surface capable of supporting the toner cake layer on the surface of the imaging member. An imagewise exposure device is also provided for generating the electrostatic latent image on the imaging member, wherein the electrostatic latent image includes image areas defined by a first charge voltage and non-image areas defined by a second charge voltage distinguishable from the first charge voltage. The toner cake delivery apparatus is provided for depositing the aforementioned toner cake layer onto the surface of the imaging member to form the desired layer of high solids content toner adjacent the electrostatic latent image on the imaging member. In addition, a charge source is provided for selectively delivering charges to the toner cake layer in an image-wise manner responsive to the electrostatic latent image on the imaging. The toner cake layer on the imaging member is selectively charged in imagewise manner to create a secondary latent image, and means are provided for inducing air breakdown in the vicinity of the toner cake layer so as to create the secondary latent image. A separator member is also provided for selectively separating portions of the toner cake layer in accordance with the secondary latent image in the toner cake layer to create a developed image corresponding to the secondary electrostatic latent image formed on the imaging member.

In accordance with another aspect of the present invention, a fourth embodiment of a contact electrostatic printing engine may be constructed to include an imaging member for receiving an electrostatic latent image. The imaging member includes a surface capable of supporting the aforementioned toner cake layer. A uniform charging device is provided for affecting a uniform charge voltage on the toner cake layer. An ionographic device is also provided for generating the electrostatic latent image on the toner layer, wherein the electrostatic latent image includes image areas defined by a first charge voltage and non-image areas defined by a second charge distinguishable from the first charge. A separator member is also provided for selectively separating portions of the toner cake layer in accordance with the latent image to create a developed image.

BRIEF DESCRIPTION OF THE DRAWINGS

The foregoing and other aspects of the present invention will become apparent from the following description in conjunction with the accompanying drawings wherein like reference numerals have been used throughout to identify identical or similar elements.

DETAILED DESCRIPTION OF THE EMBODIMENTS

The present invention is directed to an electrostatic imaging system wherein latent image development is carried out via direct surface-to-surface transfer of a highly concentrated toner cake layer, utilizing image-wise electrostatic forces to separate the layer of toner cake into image and non-image regions, regardless of where the layer of toner cake is formed prior to image separation or how the image separating electrostatic forces are generated. Although the following description will describe, by example, several embodiments of a contact electrostatic printing engine, and related processes that incorporate a photosensitive imaging member, it will be understood that the present invention contemplates the use of various alternative imaging members as are well known in the art of electrostatographic printing, including, for example, but not limited to, non-photosensitive imaging members such as a dielectric charge retaining member of the type used in ionographic printing machines, or electroded substructures capable of generating charged latent images.

In a principal feature of the invention, the highly concentrated toner cake layer described herein is derived from a supply of low solids content liquid developing material. The toner cake layer is presented in the form of a thin uniform layer of toner that is supported on a first surface which is brought into pressure contact with a second surface at a development nip formed therebetween. The toner cake layer is exposed to at least two stresses: a compressive stress in the nip as well as at the entrance thereof; and a tensile stress at the nip exit as the developed image is separated into image areas on one surface and background areas on the other surface. In order to optimize the resultant image quality, it is desirable that the toner layer have sufficient yield stress to allow the toner particles therein to maintain their integrity while being exposed to these particular stress forces. Thus, pre-selecting materials having a particular yield stress and selectively varying the yield stress of a given toner cake, can be particularly useful in defining operational parameters for optimization of the contact electrostatic printing process.

Additionally, the contact electrostatic printing process of the present invention may include development of an electrostatic latent image on an image support using supply limited development techniques, i.e., the developing potential of the latent image is not typically exhausted after being initially developed.

Additionally, the contact electrostatic printing process of the present invention includes limited relative movement between toner particles during and after latent image development, wherein the high solids content of the toner cake layer prevents toner particles from moving relative to each other.

Figure 1:
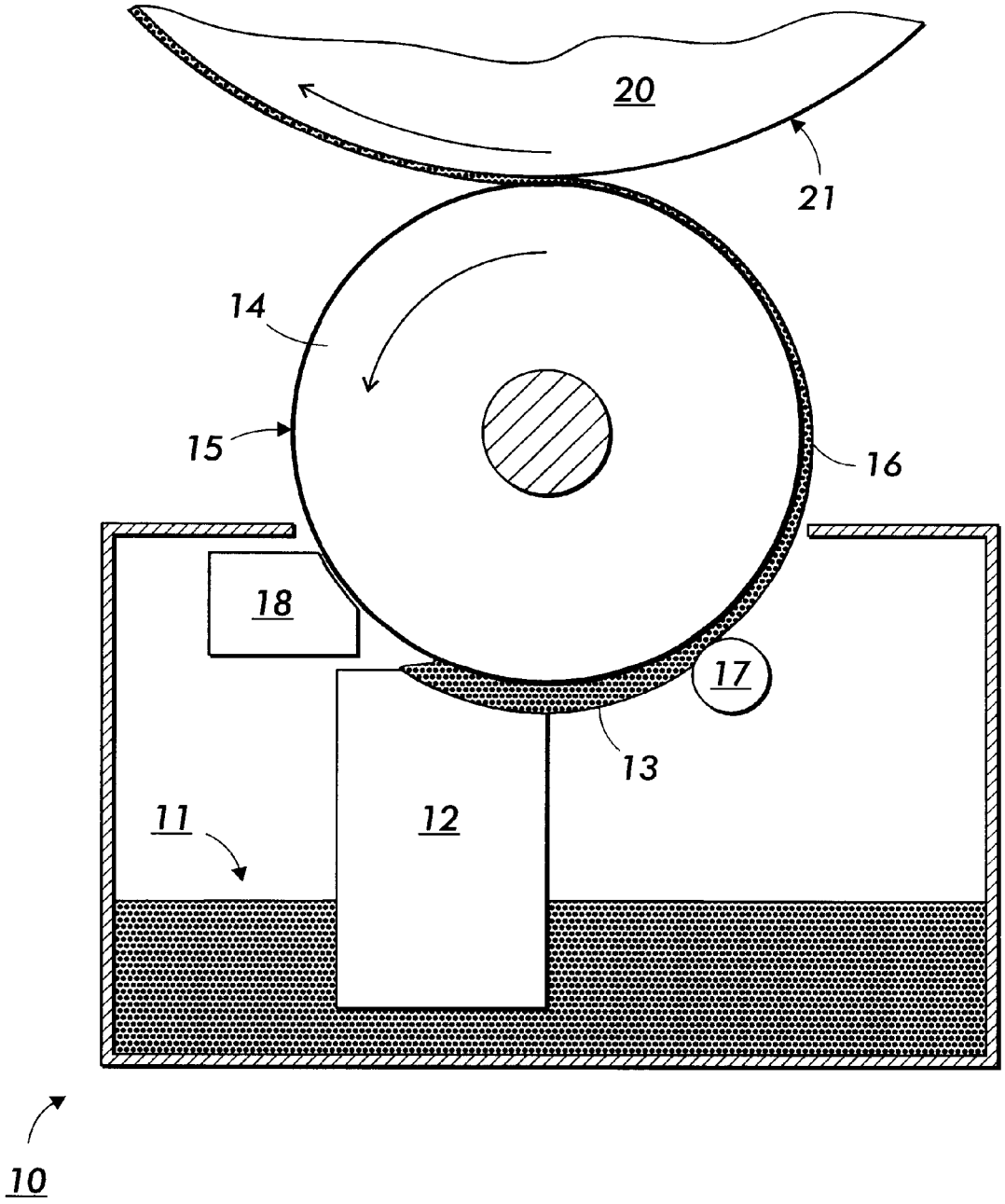
FIG. 1 is a simplified schematic representation of a first embodiment of a toner cake layer delivery apparatus constructed according to the present invention for use in a contact electrostatic printing (CEP) system. The contact electrostatic printing (CEP) engine may therefore be employed for imaging and developing a electrostatic latent image that corresponds to a desired image, wherein a layer of highly concentrated toner cake is used for development of the latent image, with subsequent separation and transfer of the developed image onto a copy substrate, thereby providing an output image on the copy substrate.

FIG. 1 is a simplified schematic representation of a toner cake layer delivery apparatus 10 constructed according to the present invention for use in an electrostatographic imaging system, such as a contact electrostatic printing (CEP) system. The contact electrostatic printing engine may be employed for imaging and developing an electrostatic latent image that corresponds to a desired image, wherein a layer of highly concentrated toner cake is used for development of the latent image, with subsequent separation and transfer of the developed image onto a copy substrate, thereby providing an output image on the copy substrate.

FIG. 1 accordingly illustrates a toner cake layer delivery apparatus 10, wherein a toner cake layer 16 of high solids content is created. The toner cake layer 16 may, after delivery to a suitable receiving member 20, be transported into pressure contact with the surface of a latent image bearing imaging member (as will be described below), such that a developed image is lo created by separating and selectively transferring portions of the toner cake layer in correspondence with the image and non-image regions of the latent image. The low solids content liquid developing material may be characterized as having a percentage of solids content that is less than the percentage of solids content desired in the toner cake layer 16. For example, is an approximately 1–10 percent solids content is considered to be characteristic of a low solids content liquid developing material; an approximately 10–50 percent solids content, or greater, and preferably on the order of approximately 15 to 35 percent solids, is considered to be characteristic of the toner cake layer 16. For the purposes of this description, the low solids content liquid developing material is generally characterized as having a solids content that is less than the solids content of the high solids content toner cake layer 16. The toner cake layer 16 also preferably exhibits the additional advantageous characteristics of a uniform thickness, selectable from the range of approximately 1–15 microns, and an accurately metered mass per unit area of approximately 0.1 mg per $cm^2$.

The toner cake layer delivery apparatus 10 includes a supply 11 of low solids content liquid developing material from which a low solids content liquid developing material applicator 12 obtains a sufficient amount of low solids content liquid developing material to apply a layer 13 of low solids content liquid developing material onto a carrier fluid separation surface (herein described as the CFS surface 15) in a movable coating member 14. In the illustrated embodiment, the coating member 14 is provided in the form of a cylindrical roll; however, alternative embodiments include, for example, a movable belt, reciprocating plate, and the like.

The coating member 14 may optionally include a vacuum present within the interior of the coating member 14 and wherein the CFS surface 15 includes sufficient fluid passageways for transfer of the carrier fluid to the interior of the coating member 14, whereby the vacuum present within the interior of the coating member 14 causes the carrier fluid to be actively drawn to the interior of the coating member 14.

The toner cake layer delivery apparatus 10 may optionally include a roll 17, which, depending on its position with respect to the CFS surface 15, may be operated to: (1) act as a metering roller to effect a selectively metered thickness for the low solids content toner cake layer 13; (2) compress the low solids content liquid developing material layer 13 into the CFS surface 15 to enhance absorption of the carrier fluid; or (3) when sufficiently impressed against the CFS surface 15 as to deform the CFS surface 15, express (i.e., force) the carrier fluid through the CFS surface 15 into the interior of the coating member 14 for subsequent removal therefrom. The aforementioned vacuum within the interior of the coating member 14 may additionally be employed to assist such carrier fluid expression through the CFS surface 15 for subsequent collection and/or removal from the interior of the coating member 14.

For example, the roll 17, when situated in close proximity to the CFS surface 15, provides a shear force against the low solids content material layer 13 deposited on the surface thereof, thereby controlling the thickness of the low solids content developing material layer. The excess material eventually falls away from the metering roll and may be transported to the supply 11 for reuse.

Figure 2:
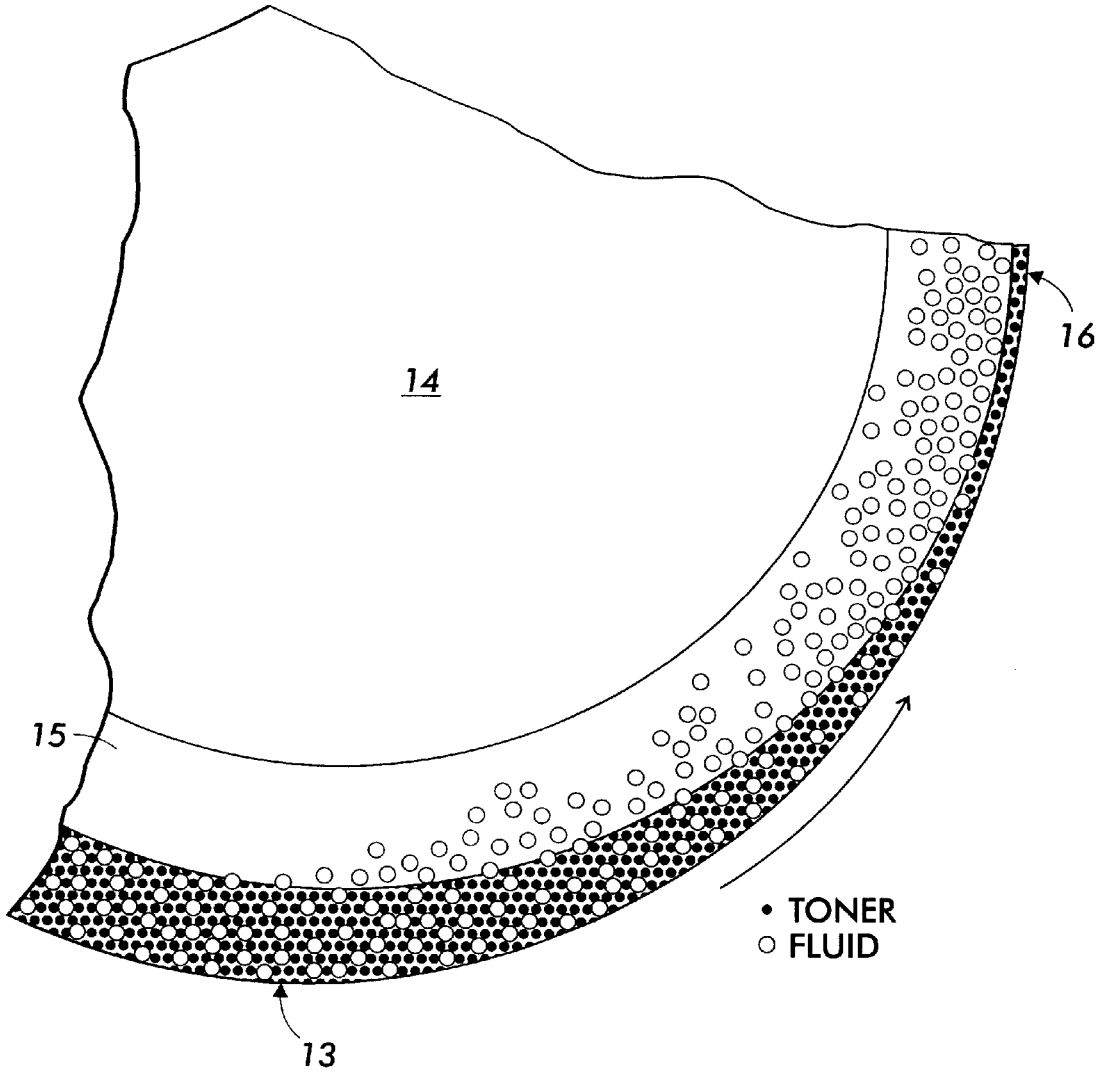
FIG. 2 is a side sectional view of a portion of CFS surface of a coating member constructed for use in the present invention.

With reference now to FIG. 2, one may appreciate now that a toner cake delivery process may be achieved, wherein application of the low solids content liquid developing material layer 13 and concurrent rotation of the coating member 14 causes the low solids content liquid developing material layer 13 to be subject to rapid migration of a selectable proportion of the carrier fluid into the CFS surface 15. The low solids content liquid developing material layer 13 thus becomes a high solids content layer in the form of the desired toner cake layer 16. Continuous rotation of the coating member 14 and operation of the low solids content liquid developing material applicator 12 allows simultaneous, or near-simultaneous, formation of the toner cake layer 16.

Such rotation of the coating member 14 also brings the toner cake layer 16 into engagement with the surface 21 of a receiving member 20. Still further rotation of the coating member 14 allows any remnants of the toner cake layer 16 to be removed from the coating member 14 by a toner cake layer cleaning unit 18. Conservation of some or all of the components of the remnants of the toner cake layer by the cleaning unit 18 is contemplated for subsequent provision to the supply 11. The quantity of liquid carrier separated from the low solids content liquid developing material layer 13 may be conserved and the conserved carrier fluid may be re-used, e.g., to replenish the supply 11.

A variety of devices or apparatus may be utilized as the applicator 12 for applying the low solids content material layer 13 to the surface of the coating member 14, such as, but not limited to, known systems directed toward the transportation of liquid developing material having toner 5 particles immersed in a carrier liquid, including various apparatus used in conventional lithographic printing applications as well as traditional liquid electrostatographic applications. For example, the applicator 12 can include a fountain-type device as disclosed generally in commonly assigned U.S. Pat. No. 5,519,473 (incorporated by reference herein). A reverse roll member may also be provided, wherein the function of the reverse roll member can be two-fold: for metering a portion of the liquid carrier away from the liquid developing material as it is applied to the surface of the coating member 14; and/or for electrostatically pushing (via a suitable biasing source, not shown) the liquid developing material toward the surface of the coating member 14. Additionally embodiments of the applicator 12 include the following: a slot die, an extrusion member, a slide, a liquid developing material curtain, a gravure roll, a forward roll, a squeegee roll, a blade apparatus, a foam roller or belt, a wired rod, a screen coater, or a shoe.

If the low solids content liquid developing material layer 13 is supplied by the supply 11 in a charged state, the coating member 14 can be biased using known devices (not shown in FIG. 1) to enhance or control the quality of the low solids content liquid developing material layer 13. If the low solids content liquid developing material layer 13 is supplied by the supply 11 in a neutral (uncharged) state, the layer concentrator 15 preferably includes a charging section to charge the layer 13 prior to its transformation to the toner cake layer 16. Chemical charging or corona charging devices, as known in the art, may be utilized.

According to the present invention, suitable embodiments of the CFS surface 15 are those constructed to separate at least a portion of the carrier fluid from the toner solids in the low solids content liquid developing material layer 13 so as to yield the desired toner cake layer 16. That is, a toner cake layer 16 having a solids content percentage level that is higher than the solids content percentage level that is originally exhibited by the low solids content liquid developing material layer 13. Separation of the carrier fluid by the CFS surface 15 will be considered herein to encompass, but not be limited to, capillary and sorbtive processes. For example, the process of "adsorption" involves separation of a substance from one phase accompanied by its accumulation or concentration at the surface of another. The adsorbing phase (i.e., the CFS surface) is the adsorbent, and the material concentrated or adsorbed at the surface of that phase is the adsorbate (i.e., the carrier fluid.) Absorption is another process in which material transferred from one phase to another interpenetrates the second phase to form a "solution". The term sorption is a general expression encompassing both processes. A large specific surface area is preferable for providing large adsorption capacity; suitable CFS surface materials include a large internal surface area in a limited volume, as are provided by large numbers of small sized pores between adsorption surfaces.

Migration of the carrier fluid away from the outermost portion of the low solids content liquid developing material layer 13, e.g., according to capillary action, may be enhanced by application of one or more additional separation mechanisms or influential factors, such as the application of thermal energy (e.g., radiant heating), gravity, or a pressure differential.

Hence, according to the foregoing, contemplated embodiments of the CFS surface 15 include, but are not limited to, one or more of the following:

(1) A porous substrate having predetermined pore dimensions and which is predisposed to carrier fluid adsorption, absorption, or both. Some porous materials exhibit a capillary action which retains a substantial proportion of marking particles at or near the exterior of the CFS surface. Examples include a microporous rubber or polymer layer, or a microporous or sintered ceramic layer.

(2) A carrier fluid filter substrate, such as a fibrous, foamed, mesh, or open cellular matrix having interstitial voids capable of carrier fluid flow but generally blocking flow of the toner particles. Contemplated embodiments of such a substrate will perform carrier fluid separation, especially when subjected to a pressure differential (e.g., a vacuum) or mechanical deformation (e.g., bending, compression, or constriction), so as to express the carrier fluid therethrough while accumulating at least a majority of the toner solids on the CFS surface. Such substrates may also exhibit the advantageous tendency, to a certain extent, for carrier fluid separation via absorption or capillary action.

(3) A substrate having a selective physical, chemical, or electrochemical attraction, considered herein as a "selective affinity", for the carrier fluid in contrast to any such affinity for the toner particles. One example is silicone rubber.

(4) A combination of substrates (1)–(3), above.

It is contemplated that, for certain applications, the level of the solids content percentage of the toner cake layer 16 may initially be lower than a desired level, whereupon the toner cake layer may be considered a "precursor" to the toner cake layer 16 ultimately required for engagement with the receiving member 20. Accordingly, more than a single revolution of the coating member 14 may be performed (with a concurrent, temporary disabling of the cleaning unit 18). For example, there may be a first revolution for transformation of the layer 13 into a "precursor" toner cake layer, followed by additional revolution (s) of the coating member 14 and respective additional cycles of operation of the applicator 12 to further increase the solids content of the "precursor" toner cake layer before the toner cake layer 16 is ultimately brought into engagement with the receiving member 20.

Figure 3:
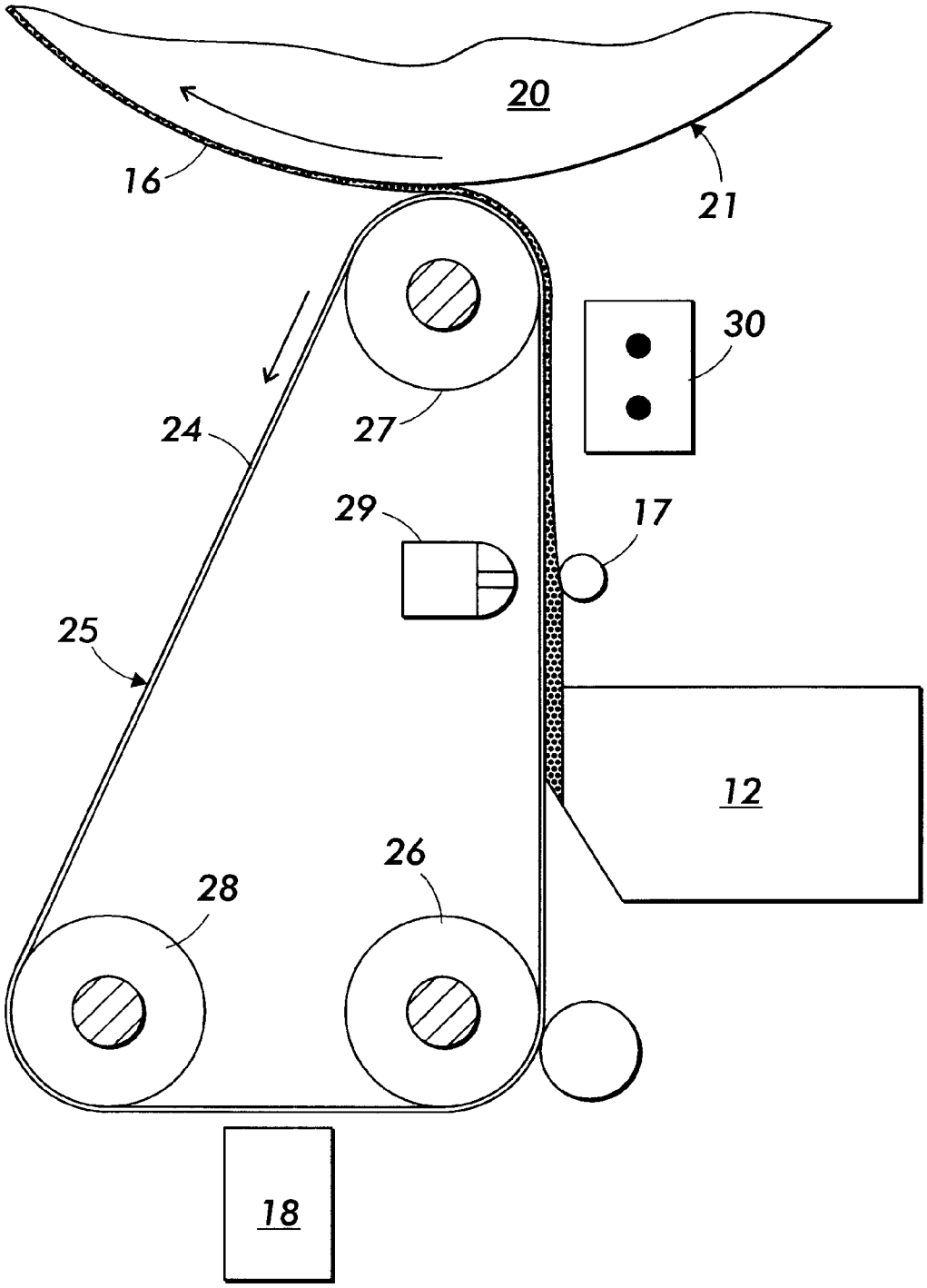
FIG. 3 is a simplified schematic representation of second embodiment of a toner cake layer delivery apparatus constructed according to the present invention for use in a contact electrostatic printing (CEP) system.

With reference now to FIG. 3, one may appreciate that although the coating member 14 of FIG. 1 is shown and described herein in the form of a cylinder, the coating member 14 may alternatively be provided in other forms, such as in the form of a continuous flexible belt 24 having a CFS surface 25 integrally situated in its outermost major surface. The interior surface of the belt 24 is entrained over a series of rollers 26, 27, 28, and the belt 24 is movable in a process direction, with appropriate arrangement of the applicator 12 and the cleaning unit 18. The roll 17 and a carrier fluid extraction device 29 applied to the underside of the belt 24, may optionally be operated singly or in tandem to affect, for example, thermal or vacuum-induced expression of the carrier fluid from the CFS surface 25 to the interior surface of the belt 24. A corona charging source 30 may be employed to charge the toner cake layer 16 prior to its transfer to the receiving member 20.

Figure 4:
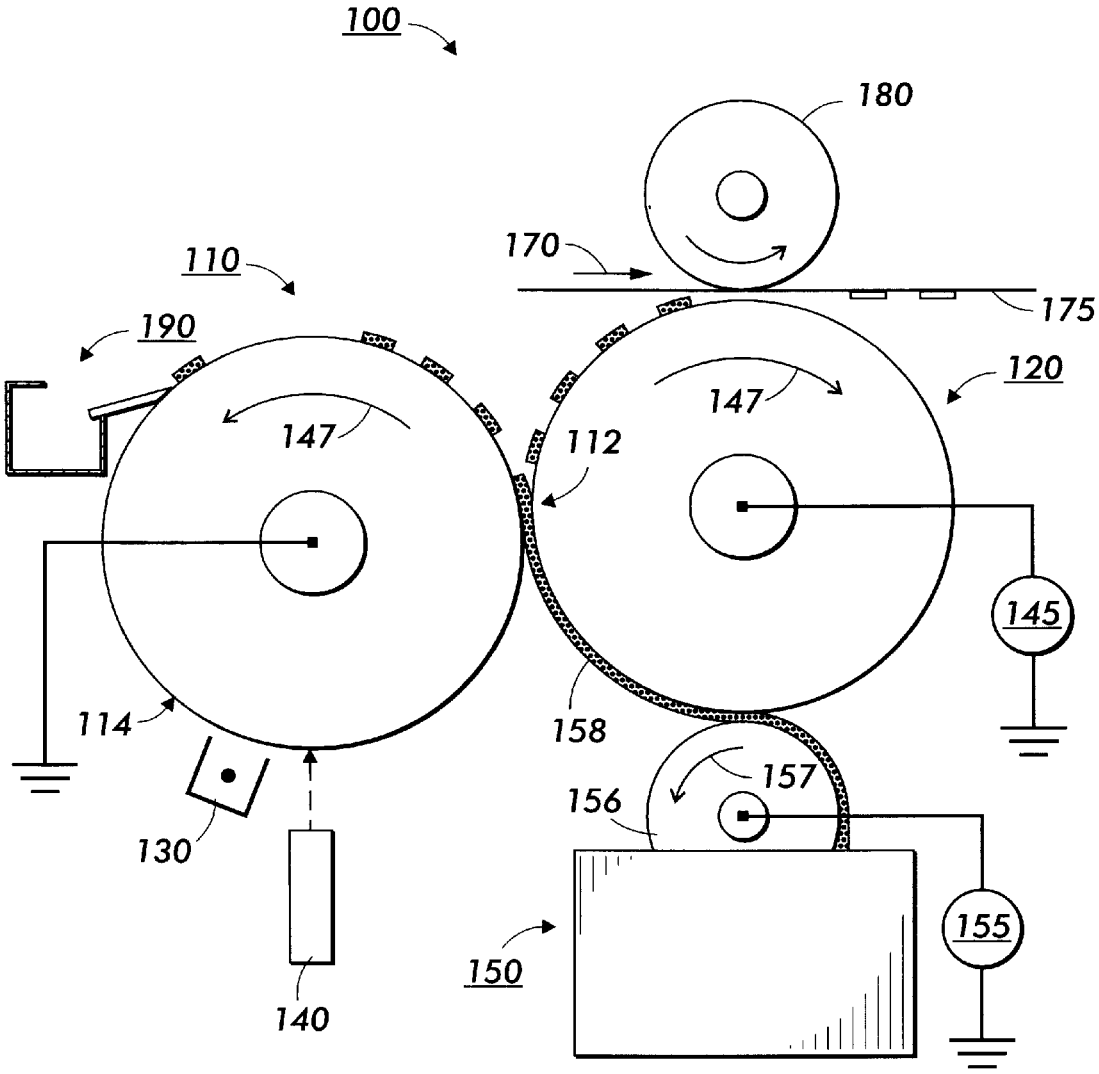
FIG. 4 is an elevational view schematically depicting a first embodiment of a CEP engine constructed for imaging and development of an electrostatic latent image, wherein a layer of highly concentrated toner cake is placed in pressure contact with a latent image bearing surface for development of the latent image.

FIG. 4 is an elevational view schematically depicting a first embodiment of contact electrostatic printing (CEP) engine 100 constructed for imaging and development of a component electrostatic latent image, with advantageous use of the toner cake layer delivery apparatus 10 of FIG. 1, wherein the above-described toner cake layer 16 is placed in pressure contact with a latent image-bearing surface for development of the latent image.

The illustrated CEP engine 100 is adapted for operation with respect to a copy substrate 175 carried on a substrate transfer path 170. The engine 100 is preferably associated with a respective pressure roller 180 for establishing at least a basic contact transfer, electrostatic transfer, or transfixing of the developed image to the copy substrate 175. An optional fuser assembly (not shown) may be provided for full or final fusing of the developed image when necessary. The engine 100 includes the toner cake layer delivery apparatus 10 of FIG. 1 for delivery of a highly concentrated toner cake layer 158 to an applicator 120 and thereafter a nip 112 is created between the applicator 120 and an imaging member 110. The toner cake layer, having a high solids content as described hereinabove, is brought into pressure contact with the surface of the imaging member 110, as will be described in detail below, whereby the toner cake layer 158 is separated into image and non-image segments. Image development occurs as a function of surface-to-surface transfer of an assemblage or aggregate of particles making up a particular section of the toner cake layer as opposed to electrostatic attraction of individual toner particles dispersed in a carrier liquid.

The CEP engine 100 comprises a first movable member in the form of an imaging member 110 including an imaging surface of any type capable of having an electrostatic latent image formed thereon. An exemplary imaging member 110 may include a typical photoconductor or other photoreceptive component of the type known to those of skill in the art of electrophotography, wherein a surface layer having photoconductive properties is supported on a conductive support substrate.

Imaging member 110 and applicator 120 are rotated so as to transport the surface thereof in a process direction 147 for implementing a series of image forming steps. It will be understood that, while imaging member 110 is shown and described herein in the form of a drum, the imaging member may alternatively be provided in the form of a continuous flexible belt which is entrained over a series of rollers, and is movable in the same direction as shown.

Initially, in the exemplary embodiment of FIG. 4, the photoconductive surface 114 of imaging member 110 passes through a charging station, which may include a corona generating device 130 or any other charging apparatus for applying an electrostatic charge to the surface of the imaging member 110. The corona generating device 130 is provided for charging the photoconductive surface 114 of imaging member 110 to a relatively high, substantially uniform electrical charge potential. It will be understood that various charging devices, such as charge rollers, charge brushes and the like, as well as inductive and semiconductive charge devices, among other devices which are well known in the art, may be utilized at the charging station for applying a charge potential to the surface of the photosensitive imaging member 110.

After the imaging member 110 is brought to a substantially uniform charge potential, the charged surface thereof is advanced to an image exposure station, identified generally by reference numeral 140. The image exposure station projects onto the charged photoconductive surface a light image corresponding to the desired component image. In the case of an imaging system having a photosensitive imaging member 110, the light image projected onto the surface of the imaging member 110 selectively dissipates the charge thereon for recording an electrostatic latent image on the photoconductive surface 114, wherein the electrostatic latent image comprises, in image configuration corresponding to the input image information, image areas defined by a first charge voltage potential and non-image areas defined by a second charge voltage potential. The image exposure station 140 may incorporate various optical image projection and formation components as are known in the art, and may include various well known light lens apparatus or digital scanning systems for forming and projecting an image from an original input document onto the imaging member 110. Alternatively, various other electronic devices available in the art may be utilized for generating electronic information to create the electrostatic latent image on the imaging member. It will be understood that the electrostatic latent image may be comprised of image and non-image areas that are defined by regions having opposite charge polarities or by regions having distinguishable first and second voltage potentials which are of the same charge polarity.

A second movable member in the form of an applicator 120 is provided in combination with a toner cake layer delivery apparatus 150 constructed as described hereinabove, including therein a feed line or reservoir adapted to provide a supply of low solids content liquid developing material, generally made up of toner particles immersed in a liquid carrier material and also typically including a charge director for providing a mechanism for producing an electrochemical reaction in the liquid developing material composition which generates the desired electrical charge on the toner particles. Generally, the liquid carrier material is present in a large amount in the introductory supply of liquid developing material. The liquid carrier material may be present in an amount of from about 90 to as much as 99.5 percent by weight, although the percentage amount may vary from this range provided that the objectives of the present invention are achieved.

A coating member 156 is rotated in a direction as indicated by arrow 157 for transporting the toner cake layer 158 onto the surface of the applicator 120. The uniformly distributed toner cake layer 158 is made up of densely packed toner particles in a small percentage of liquid carrier. Depending on the materials utilized in the liquid developing material composition, as well as other process parameters related to the printing system, such as process speed and the like, a toner cake layer having sufficient thickness, preferably between 2 and 15 microns and more preferably on the order of 5 microns or less, is formed on the surface of the applicator 120 by providing adequate proximity and/or contact pressure between the coating member 156 and the roll surface of applicator 120. Alternatively, or additionally, an electrical biasing source 155 may be coupled to the coating is member 156 to assist in electrostatically moving the toner particles onto the surface of the applicator 120. Thus, in one exemplary embodiment, the coating member 156 can be coupled to the electrical biasing source 155 for implementing a so-called forward biasing scheme, wherein the coating member 156 is provided with an electrical bias of sufficient magnitude and polarity for creating electrical fields extending from the coating member 156 to the surface of the applicator 120. These electrical fields cause toner particles to be transported to the surface of the applicator 120, for forming a toner cake layer 158 having a highly concentrated and substantially uniform distribution of toner particles therein.

After the toner cake layer 158 is formed on the surface of the applicator 120, the toner cake layer 158 is brought into pressure contact with the latent image bearing surface of imaging member 110 by transporting the toner cake layer 158 through a process nip 112 formed by the operative engagement of the applicator 120 and the imaging member 110. The toner cake layer 158 has a solid-like property in the process nip 112 such that the presence of hydrodynamic lift occurring in the nip, as disclosed in some prior art references noted hereinabove, is not applicable to the concepts of the present invention.

One objective of the engine 100 illustrated in FIG. 4 is to place the toner cake layer 158 under pressure in the process nip 112; accordingly, it may desirable to provide either the applicator 120 or the imaging member 110 in the form of a conformable member for permitting the surface of one member to correspond in form or character to the opposing surface in the nip region. When the surface of the applicator 120 bearing the toner cake layer 158 is engaged with the latent image bearing photoconductive surface 114 of imaging member 110, the toner cake layer 158 is distributed within the nip created therebetween such that toner particle motion and/or liquid flow is negligible with no distortion being present or induced between the toner particles in the toner cake layer 158.

It will be understood that the presence of the latent image on the imaging member 110 may generate some fringe fields in areas of interface between image and non-image areas of the latent image. However, compared to conventional development, the present invention will substantially eliminate fringe field related image defects due to the solid-like property of the toner cake layer 158 at the entrance of the nip.

An electrical biasing source 145 is coupled to the applicator 120 for applying an electrical bias thereto so as to generate electrostatic fields between the surface of applicator 120 and the image or non-image areas on the surface of the imaging member 110. These electrostatic fields generate fields in opposite directions, either toward the surface of the imaging member 110 or towards the surface of the applicator 120 in accordance with image and non-image portions of the latent image. Moreover, these fields cause the separation of the image and non-image areas of the toner cake layer 158 upon separation of the imaging member 110 and the applicator 120 at the nip exit for simultaneously separating and developing the toner cake layer 158 into image and non-image portions on the opposed surfaces of the imaging member 110 and the applicator 120. The applicator 120 may be biased so as to repel image areas, thereby producing a developed image made up of selectively separated and transferred portions of the toner cake layer 158 on the surface of the imaging member 110, while leaving background image byproduct on the surface of the material applicator 120. The applicator 120 is preferably electrically biased to be at a voltage intermediate the voltage potential of the exposed and unexposed portions of the electrostatic latent image on the imaging member 110.

Development occurs with substantially reduced movement of the toner particles. The development can therefore be implemented at an increased rate to allow high speed processing and improved printing throughput rates.

The resultant image/background separation is illustrated in the CEP engine 100 of FIG. 4. In the illustrated embodiment, the applicator 120 is provided with an electrical bias appropriate for attracting image areas while repelling non-image areas toward the imaging member 110, thereby maintaining toner portions corresponding to image areas on the surface of the applicator 120, yielding a developed image on the applicator 120.

This toner cake layer 158 in the process nip 112, and therefore the process nip gap between the imaging member 110 and the applicator 120, is preferably less than 15 microns and more preferably about 5 microns. A process nip gap of less than 5 microns enables development of images of greater than 800 dots per inch (dpi).

This toner cake layer 158 is exposed to at least two very different and opposed stress forces as it is transported into, through and out of the process nip. As the toner cake layer 158 enters the process nip 112 and travels therethrough, compressive stress forces are generated and exerted upon the toner cake layer 158. Thereafter, as the toner layer exits the process nip 112 and the toner cake layer 158 is separated into image and background areas on the opposed surfaces of the imaging member 110 and the applicator 120, tensile stress forces are generated and exerted upon the toner layer 158.

Image quality is partially dependent on the ability of the toner cake layer 158, and in particular, the toner particles therein, to maintain their integrity as an assemblage of toner particles such that lateral movement of the toner particles is prevented when the liquid developing material layer is exposed to compression stress forces, thereby allowing the toner particles to maintain their initial distribution and density levels as the toner cake layer 158 enters the nip 112, and further allowing the toner particles of the liquid developing toner cake layer 158 to sustain an image pattern as it passes through the nip. At the exit, the toner patch in the image area will stay with one surface and the toner patch in the background area will stay with another surface according to the image-wise electrical field. In addition, image quality is further dependent on the ability of the toner particles in the toner cake layer 158 to break sharply along the image-background boundary where the electrostatic force is substantially zero. Thus, it is desired for the toner cake layer 158 to attain a shear tensile yield stress which is substantially lower than the stress induced by the electric fields at the exit of the nip 112 for preventing image quality degradation when the liquid developing material layer is exposed to tensile stress forces at the nip exit while separating into image and non-image regions on opposed surfaces. In the illustrated process nip 112, the toner particles are attracted in an image-wise fashion toward the surface of the imaging member 110. The toner particles are required to migrate a relatively small distance, therefore allowing for increased process speeds.

The toner particles are generally required to migrate less than one half the width or gap of the process nip 112. As a result of the small toner migration, the image areas and background are interspersed due to each extending from the respective surfaces of the imaging member 110 and applicator 120 more than one half of the gap of the process nip 112. The thickness of each of the toner layers of the background and the image area are therefore greater than one half the gap of the process nip 112. The spaces in the process nip from which the toner migrates continue to be occupied by carrier fluid. As a result of the relatively small toner migration, the toner layer of the background and the toner layer of the developed image are in substantial contact. There is as a result, edge to edge contact of the opposed toner layers in the process nip 112.

The developed image and background are separated at the exit of the process nip 112. The interspersed and contacting developed image area and background toner layers break or snap cleanly at the edge to edge contact. The clean breaking of the edge to edge contact provides for improved edge definition of the developed image relative to prior development systems.

In the illustrated embodiment, continued rotation of material applicator 120 allows the developed image to be transferred from the surface of the image member 110 to a copy substrate 175 carried on the substrate transfer path 170.

Figure 5:
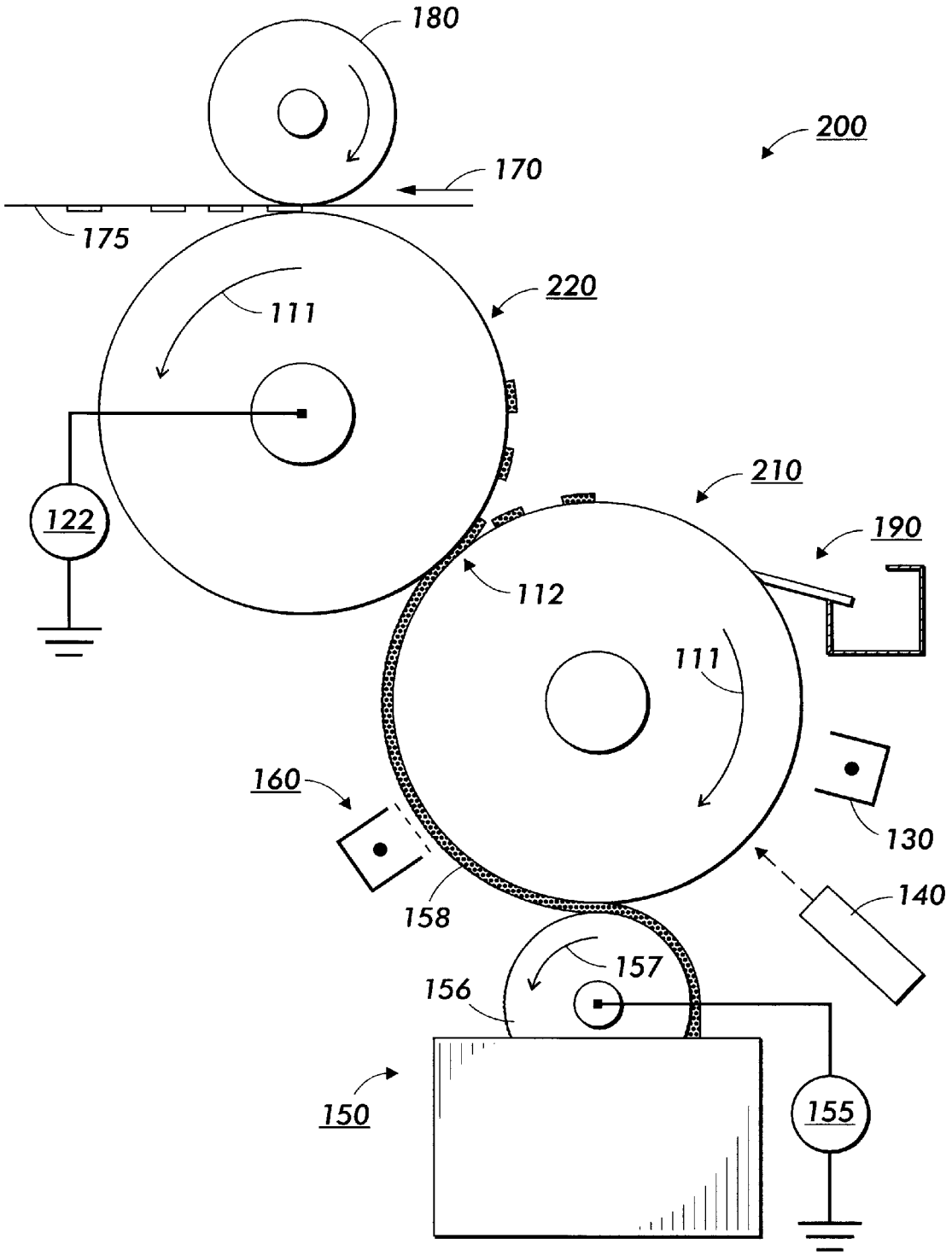
FIG. 5 is an elevational view schematically depicting a second embodiment of a CEP engine constructed for use in a contact electrostatic printing for imaging and development of an electrostatic latent image, wherein a layer of highly concentrated toner cake on an electrostatic latent image bearing member is selectively charged in imagewise manner to create a secondary latent image.

FIG. 5 is an elevational view schematically depicting a second embodiment of a CEP engine constructed for use in imaging and development of an component electrostatic latent image, wherein a highly concentrated toner cake layer on an electrostatic latent image bearing member is selectively charged in imagewise manner to create a secondary latent image.

As illustrated in FIG. 5, the CEP engine 200 may be constructed for operation in a fashion similar to that described hereinabove with respect to the CEP engine 100 of FIG. 3, but adapted for the formation of a secondary latent image in the toner layer, as will now be described. After the toner cake layer 158 is formed on the surface of an imaging member 210, the toner cake layer 158 is charged in an image-wise manner. After the imaging member 210 is brought to a substantially uniform charge potential by the corona generating device 130, the charged surface thereof is advanced in a process direction 111 to an image exposure station, identified generally by reference numeral 140. An ion source 160 (represented schematically in FIG. 5 as a scorotron device) is provided for introducing free mobile ions in the vicinity of the charged latent image to facilitate the formation of an image-wise ion stream extending from the source 160 to the latent image on the surface of the imaging member 210. The image-wise ion stream generates a secondary latent image in the toner layer made up of oppositely charged toner particles in image configuration corresponding to the latent image.

The function of the ion source 160 is to charge the toner layer 158 in an image-wise manner. This process will be described with respect to a negatively charged toner layer, although it will be understood that the process can also be implemented using a positively charged toner layer. In addition, the process of the present invention can also be implemented using an uncharged or neutral toner layer.

The initially charged toner cake layer 158 may now be considered, for purposes of the following description, as a distributed layer of negatively charged toner particles having the thickness of a single toner particle. The toner cake resides on the surface of the imaging member 210 which is being transported from left to right past the broad source ion source 160. As previously described, the primary function of the ion source 160 is to provide free mobile ions in the vicinity of the imaging member 210 having the toner layer and latent image thereon. As such, the broad source ion device may be embodied as various known devices, including, but not limited to, any of the variously known corona generating devices available in the art, as well as charging roll type devices, solid state charge devices and electron or ion sources analogous to the type commonly associated with ionographic writing processes.

The preferred ion source 160 includes a corona generating electrode enclosed within a shield member surrounding an electrode on three sides. A wire grid covers the open side of the shield member facing the imaging member 210. In operation, the corona generating electrode, otherwise known as a coronode, is coupled to an electrical biasing source capable of providing a relatively high voltage potential to the coronode, which causes electrostatic fields to develop between the coronode and the grid and the imaging member 210. The force of these fields causes the air immediately surrounding the coronode to become ionized, generating free mobile ions which are repelled from the coronode toward the grid and the imaging member 210. The scorotron grid is biased so as to be operative to control the amount of charge and the charge uniformity applied to the imaging surface of the imaging member 210 by controlling the flow of ions through the electrical field formed between the grid and the imaging surface.

Accordingly, the ion source 160 is operated to provide ions having a charge opposite the toner layer charge polarity. Thus, in the case of a negatively charged toner cake layer 158, the ion source 160 is preferably provided with an energizing bias at its grid intermediate the potential of the image and non-image areas of the latent image on the imaging member 210. In areas where the latent image is at a potential lower than the bias potential of the charging source grid, the bias potential generates electrostatic field lines in a direction toward the imaging member 210 and toner cake layer 158. Conversely, electrostatic field lines are generated in a direction away from the imaging member 210 and toner cake layer 158 in areas where the latent image is at a potential higher than the bias potential of the charging source grid. The free flowing ions generated by the ion source 160 are captured by toner cake layer 158 in a manner corresponding to the latent image on the imaging member 210, causing image-wise charging of the toner cake layer 158, thereby creating a secondary latent image within the toner cake layer 158 that is charged opposite in charge polarity to the charge of the original latent image. Under optimum conditions, the charge associated with the original latent image will be captured and converted into the secondary latent image in the toner cake layer 158 such that the original electrostatic latent image is substantially or completely dissipated into the toner cake layer 158.

Once the secondary latent image is formed in the toner cake layer 158, the secondary latent image bearing portion of the toner cake layer 158 is advanced to an image separator 220. Image separator 220 may be provided in the form of a biased roll member having a surface adjacent to the surface of the imaging member 210 and preferably contacting the toner cake layer 158 that resides on imaging member 210. An electrical biasing source 122 is coupled to the image separator 220 to bias the image separator 220 so as to attract either image or non-image areas of the latent image formed in the toner cake layer 158 for simultaneously separating and developing the toner cake layer 158 into image and non-image portions. In the illustrated embodiment, the image separator 220 is biased with a polarity opposite the charge polarity of the image areas in the toner cake layer 158 for attracting image areas therefrom, thereby producing a developed image made up of selectively separated and transferred portions of the toner cake on the surface of the image separator 220, while leaving background image byproduct on the photosensitive surface of the imaging member 210.

After the developed image is formed on the surface of the imaging separator 220, the developed image may then be transferred to a copy substrate. In the illustrated embodiment, the developed image is transferred from the surface of the imaging separator 220 to the copy substrate 175 carried on the transfer path 170.

Additional details of the construction and operation of the illustrated embodiment 200 of the CEP engine and variations thereof may be found in commonly-assigned U.S. Pat. No. 5,826,147, the disclosure of which is incorporated herein by reference.

Figure 6:
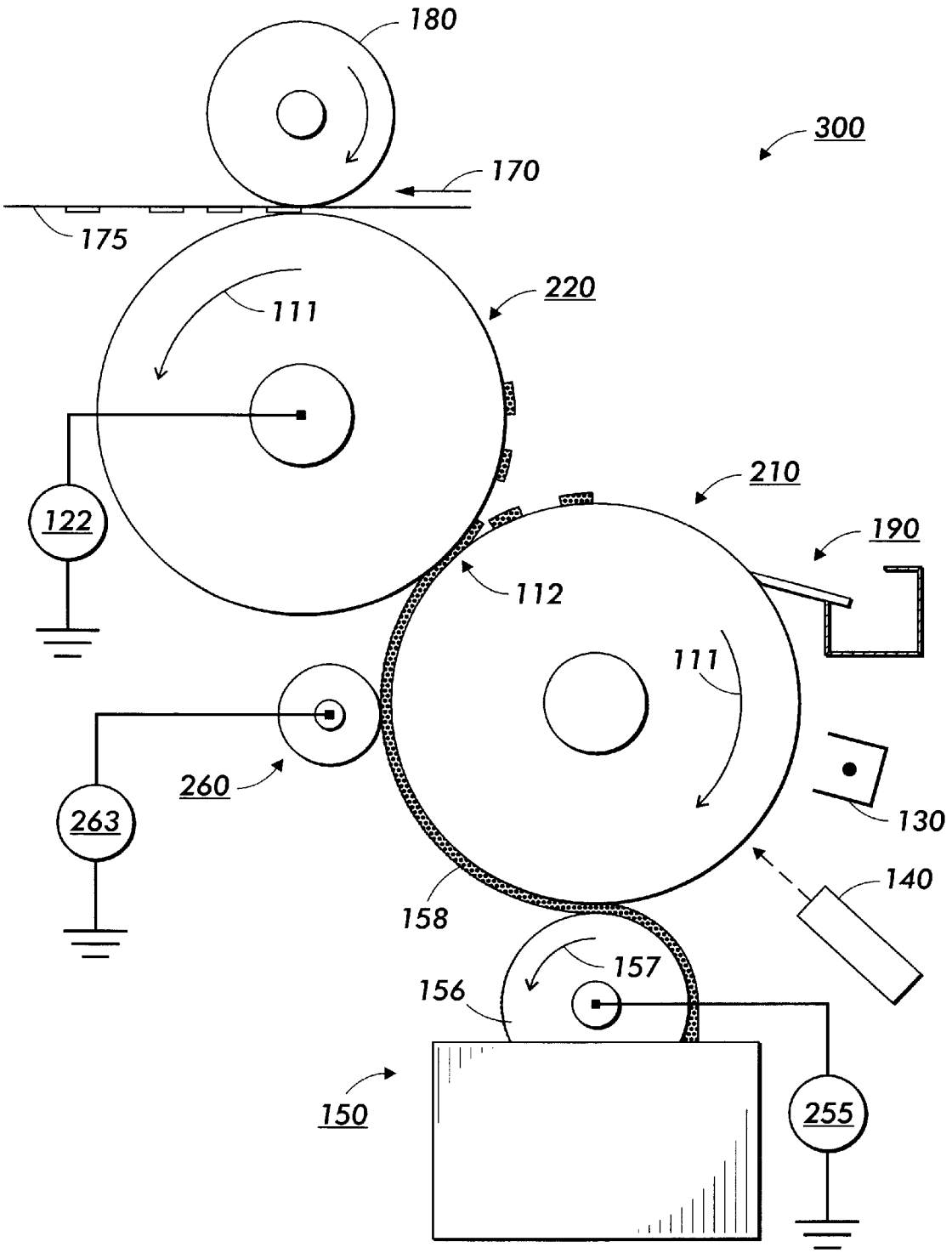
FIG. 6 is an elevational view schematically depicting a third embodiment of a CEP engine constructed for use in a contact electrostatic printing system for imaging and development of an electrostatic latent image, wherein a layer of highly concentrated toner cake on an electrostatic latent image bearing member is selectively charged in imagewise manner to create a secondary latent image, and wherein means are provided for inducing air breakdown in the vicinity of the toner cake layer so as to create the secondary latent image.

FIG. 6 is an elevational view schematically depicting a third embodiment of a CEP engine constructed for imaging and development of an electrostatic latent image, wherein a highly concentrated toner cake layer on an electrostatic latent image bearing member is selectively charged in imagewise manner to create a secondary latent image, and wherein means are provided for inducing air breakdown in the vicinity of the liquid developing material layer so as to better create the secondary latent image.

As illustrated in FIG. 4, the CEP engine 300 may be constructed for operation similar to that described hereinabove with respect to the CEP engine 200, and wherein means are provided for inducing air breakdown in the vicinity of the liquid developing material layer so as to create the secondary latent image, as will now be described.

When two conductors are made proximate with a voltage applied their between, electrical discharge will occur as the voltage is increased to the point of air breakdown Thus, at a critical threshold voltage, a discharge current occurs in the air gap between the conductors. This critical point is commonly known as the Paschen threshold voltage. When such conductors have a minimal gap (e.g., a few thousandths of an inch), the discharge can occur without arcing, such that a discharge current will be caused to flow across the gap.

As previously described, the primary function of the ion source 160 is to provide free mobile ions in the vicinity of the imaging member 210 having the toner cake layer 158 and latent image so as to induce image-wise charging. A biased roll member 260 is coupled to an electrical biasing source 263 capable of providing a voltage potential to the roll member 260 that is sufficient to produce air breakdown in the vicinity of the latent image on the imaging member 210. Preferably, the voltage applied to the roll 260 is maintained at a predetermined potential such that electrical discharge is induced only in a limited region where the surface of the roll member 260 and the imaging member 210 are in very close proximity and the voltage differential between the roll member 260 and the image and/or non-image areas of the latent image exceed the Paschen threshold voltage. To effect that which will be known as "one-way breakdown", it is contemplated that the bias applied to the roll member 260 is sufficient to exceed the Paschen threshold voltage only with respect to either one of the image or non-image areas of the original latent image on the imaging member. Alternatively, to effect that which will be known as "2-way breakdown", the bias applied to the roll member 260 may be sufficient to exceed the Paschen threshold with respect to both the image or non-image areas of the original latent image. The air breakdown induced in these situations will can be caused to occur in a manner such that field lines are generated in opposite directions with respect to the image and non-image areas.

For example, in the case where the Paschen threshold voltage is about 400 volts, and the image and non-image areas have voltage potentials of about 0 and −1200 volts respectively, a bias potential applied to roll member 260 of approximately −200 volts will result in air breakdown that generates charges only in the region of the non-image areas such that the toner particles adjacent to this region will be effected. Conversely, a bias of −1000 volts applied to roll member 260, for example, will result in charge generation in the region of the image area of the latent image, with ions flowing in the opposite direction. In yet another alternative, a bias of approximately −600 volts applied to roll member 260 will result in charge generation in the areas adjacent both image and non-image areas with ions flowing in opposite directions. In this so-called 2-way air breakdown mode, electrical discharge via air breakdown is induced in a pre-nip region immediately prior to a nip region created by contact between the imaging member 210 and the roll member 260. The electrical discharge causes electrostatic fields to develop between the roll member 260 and the imaging member 210 in the pre-nip region. In turn, the force of these fields causes the air to become ionized, generating free mobile ions which are directed toward the imaging member 210. The magnitude of the bias potential applied to the roll member 260 operates to control the image-wise ionization and the amount of charge and the charge uniformity applied to the imaging surface on the imaging member 210. Thus, in accordance with the example described above, 2-way breakdown can be induced by applying a bias voltage to roll member 260 which is sufficient to exceed the Paschen threshold with respect to both image and non-image areas of a latent image on an imaging member brought into the vicinity of the roll member 260. Providing that this bias is applied to roll member 260 in a range intermediate to the potential associated with the image and non-image areas, there is proper control of the direction of charge flow for creating the desired secondary latent image in the toner cake layer 158.

Accordingly, the image-wise charging of a neutrally charged toner cake layer 158 can induce air breakdown in both the pre-nip and post-nip regions to provide the opposite charge polarity ions required to appropriately image-wise charge the neutral toner cake layer. Such charging can be enabled by a segmented version of the bias roll member 260, as disclosed generally in U.S. Pat. No. 3,847,478, the disclosure of which is incorporated by reference herein. It will be recognized that the bias voltage applied to the roll member 260 is not required to be intermediate the potentials associated with the image and non-image areas of the original latent image on the imaging member. Rather, a voltage which causes air breakdown relative to only one of either the image or non-image areas need be applied to the roll member.

Additional details of the construction and operation of the illustrated contact electrostatic printing engine 300, and variations thereof, may be found in commonly-assigned U.S. Pat. No. 5,937,243, the disclosure of which is incorporated herein by reference.

Figure 7:
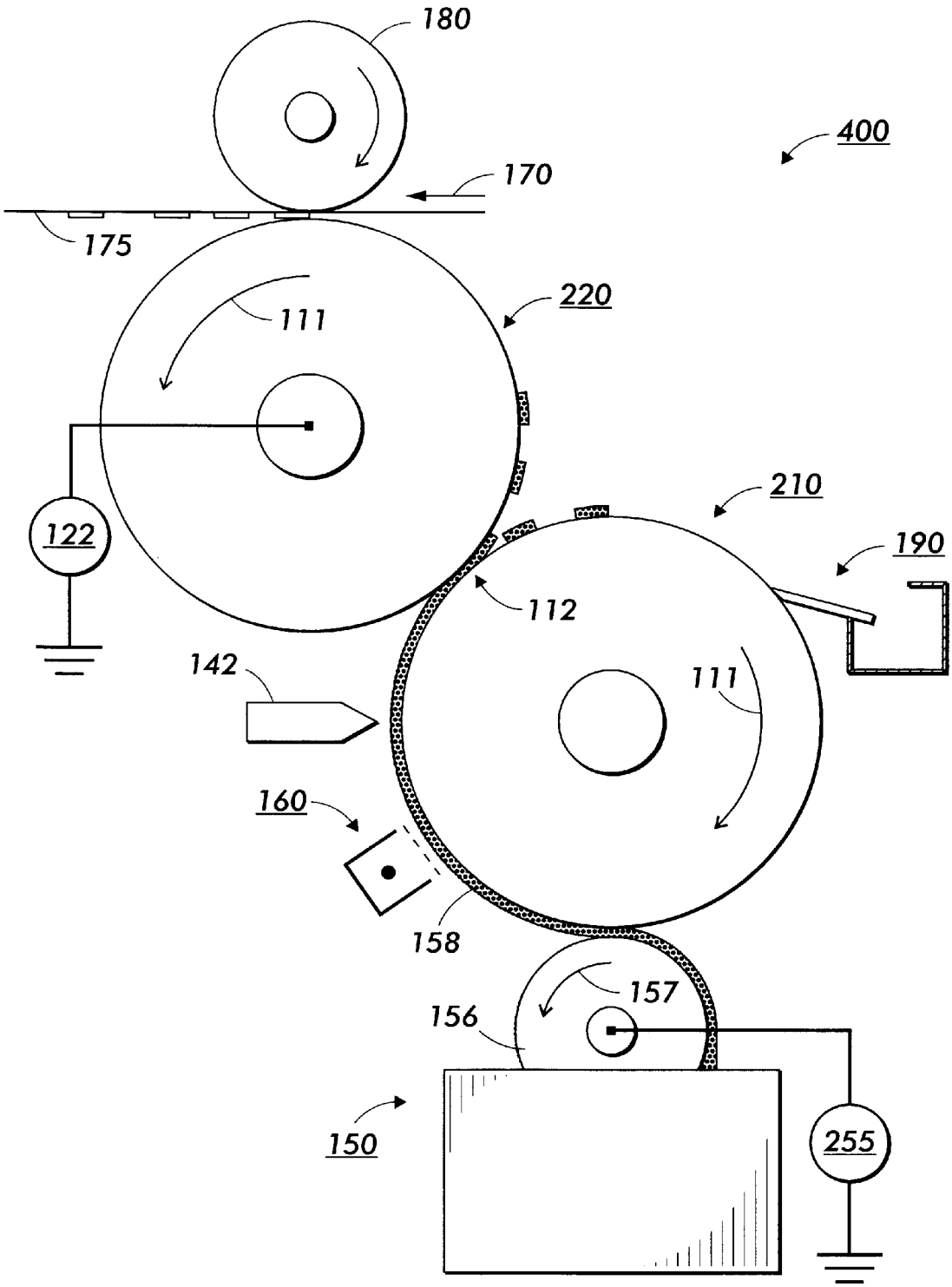
FIG. 7 is an elevational view schematically depicting a fourth embodiment of a CEP engine constructed for use in a contact electrostatic printing for imaging and development of an electrostatic latent image, wherein a uniformly charged layer of highly concentrated toner cake on an electrostatic latent image bearing member is selectively charged in imagewise manner by an ionographic device to create a latent image.

FIG. 7 is an elevational view schematically depicting a fourth embodiment of a CEP engine constructed for imaging and development of an electrostatic latent image, wherein a highly concentrated toner cake layer on an electrostatic latent image bearing member is selectively charged in imagewise manner to create a latent image, and wherein ionographic means are provided for inducing the latent image in the toner cake layer received on the imaging member 210.

As illustrated in FIG. 7, the CEP engine 400 may be constructed for operation similar to that described hereinabove with respect to the CEP engine 200; however, the imaging member 210 is constructed to include a conductive, semiconductive, or dielectric surface. An optional ion source 160 may be employed to uniformly charge the toner cake layer 158. In lieu of the corona generating device 130 and the exposure station 140, an ionographic device 142 is operated to selectively charge the toner cake layer 158 in an imagewise fashion to create a latent image. The latent image bearing portion of the toner cake layer 158 is advanced in a process direction 111 to the image separator 220. The electrical biasing source 122 is coupled to the image separator 220 to bias the image separator 220 so as to attract either image or non-image areas of the latent image formed in the toner cake layer 158 for simultaneously separating and developing the toner cake layer 158 into image and non-image portions. In the illustrated embodiment, the image separator 220 is biased with a polarity opposite the charge polarity of the image areas in the toner cake layer 158 for attracting image areas therefrom, thereby producing a developed image made up of selectively separated and transferred portions of the toner cake on the surface of the image separator 220, while leaving background image byproduct on the surface of the imaging member 210. After the developed image is formed on the surface of the imaging separator 220, the developed image may then be transferred to the copy substrate 175. The pressure roller 180 and electrical biasing source 122 act as a transfer assembly to establish at least one of a basic contact transfer, electrostatic transfer, or transfixing of the developed image to the copy substrate 175.

In the above-described embodiments of a CEP engine, the developed image transfer step may be effected via selectable means known in the art, and in some embodiments may be effected in accordance with the registration requirements of a composite color image, such as an electrostatic transfer apparatus including a corona generating device or a biased transfer roll. In yet another alternative, image transfer can be accomplished via surface energy differentials wherein the surface energy between the image and the member supporting the image prior to transfer is lower than the surface energy between the image and the copy substrate, inducing transfer thereto.

A pressure transfer roll system may be employed to tack the developed image to the copy substrate 175; this system may include a heating and/or chemical application device for assisting in the pressure transfer and fixing of the developed image on the copy substrate 175. The developed image may be transferred to a copy substrate 175 via a heated pressure roll 180, whereby pressure and heat are simultaneously applied to the developed image to simultaneously transfer and at least partially fuse (e.g., transfuse) the developed image to the copy substrate 175.

A background image is usually removed in preparation for a subsequent imaging cycle. A simple blade cleaning apparatus 190 may be employed as is known in the art. Alternative embodiments may include a brush or roller member for removing toner from the surface on which it resides. The removed toner may be transported to a toner sump or other conservation vessel so that the waste toner can be recycled and used again to generate another toner cake layer 158 in subsequent imaging cycles.

Additional details of the construction and operation of the illustrated contact electrostatic printing engine 400, and variations thereof, may be found in commonly-assigned U.S. Pat. No. 5,966,570, the disclosure of which is incorporated herein by reference.

Figure 8:
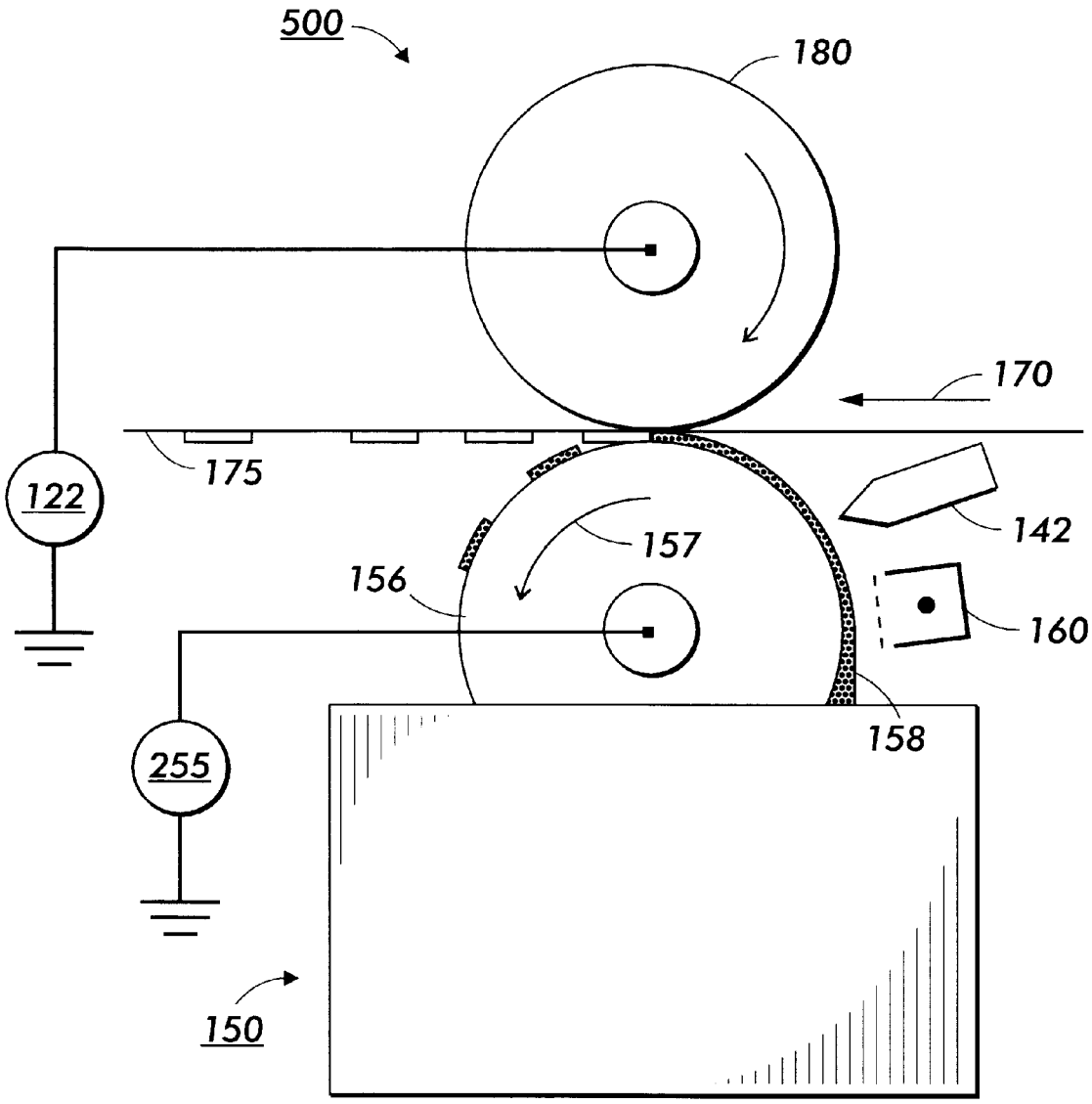
FIG. 8 is an elevational view schematically depicting a fifth embodiment of a CEP engine constructed for imaging and development of an electrostatic latent image, wherein a uniformly charged layer of highly concentrated toner cake on a coating member is selectively charged in imagewise manner by an ionographic device to create a latent image.

FIG. 8 is an elevational view schematically depicting a fifth embodiment of a CEP engine constructed for imaging and development of an electrostatic latent image, wherein a uniformly charged layer of highly concentrated toner cake on a coating member is selectively charged in imagewise manner by an ionographic device to create a latent image. The CEP engine 500 may be constructed for operation similar to that described hereinabove with respect to the CEP engine 400; however, the imaging member 210 and image separator 200 are omitted and the coating member 156 is constructed to include a conductive CFS surface upon which the toner cake layer 158 is prepared. (A conductive CFS surface may be constructed, e.g., using conductive porous polymer foam.) An optional ion source 160 may be employed to uniformly charge the toner cake layer 158. An ionographic device 142 is then operated to selectively write a charge pattern on the toner cake layer 158 in an imagewise fashion to create a latent image. The latent image bearing portion of the toner cake layer 158 is advanced in a process direction 157 into a process nip with the copy substrate 175 carried on the substrate transfer path 170. The pressure roller 180 and electrical biasing source 122 act as a transfer assembly to establish at least one of a basic contact transfer, electrostatic transfer, or transfixing of the developed image to the copy substrate 175. An optional fuser assembly (not shown) may be provided for full or final fusing of the developed image when necessary. The electrical biasing source 122 is coupled to the roller 180 to attract image areas of the latent image formed in the toner cake layer 158 for simultaneously separating and developing the toner cake layer 158 into image and non-image portions. In the illustrated embodiment, the roller 180 is biased with a polarity opposite the charge polarity of the image areas in the toner cake layer 158 for attracting image areas therefrom, thereby producing a developed image made up of selectively separated and transferred portions of the toner cake layer 158 on the surface of the copy substrate 175, while leaving background image byproduct on the surface of the coating member 156. After the developed image is formed on the surface of the copy substrate 175, the non-image areas may then be cleaned by the toner cake layer delivery apparatus 150.

Additional details of the construction and operation of the illustrated contact electrostatic printing engine 500, and variations thereof, may be found in commonly-assigned U.S. Pat. No. 5,966,570, the disclosure of which is incorporated herein by reference.

The liquid carrier medium utilized in the low solids content developing material may be selected from a wide variety of materials, including, but not limited to, any of several hydrocarbon liquids conventionally employed for liquid development processes, including hydrocarbons, such as high purity alkanes having from about 6 to about 14 carbon atoms, such as Norpar® 12, Norpar® 13, and Norpar® 15, and including isoparaffinic hydrocarbons such as Isopar® G, H, L, and N, available from Exxon Corporation. Other examples of materials suitable for use as a liquid carrier include Amsco® 460 Solvent, Amsco® OMS, available from American Mineral Spirits Company, Soltrol®, available from Phillips Petroleum Company, Pagasol®, available from Mobil Oil Corporation, Shellsol®, available from Shell Oil Company, and the like. Isoparaffinic hydrocarbons provide a preferred liquid media, since they are colorless, environmentally safe. These particular hydrocarbons may also possess a sufficiently high vapor pressure so that a thin film of the liquid evaporates from the contacting surface within seconds at ambient temperatures.

The toner cake layer 158 achieves high enough yield stress to substantially eliminate lateral movement of the toner particles in the toner cake layer 158 when exposed to compression stresses generated at the entrance to and in the nip 112, while also having sufficiently low yield stress to permit the toner layer to act as a liquid in the presence of tensile stress forces present in the vicinity of the exit of the nip. Further definition of operational parameters for such optimization of the contact electrostatic printing process, via pre-selecting materials having a particular yield stress and/or selectively varying the yield stress of a given liquid developing material, may be determined by those skilled in the art so as to pre-select the materials making up the liquid developing material, the toner particle concentration of the liquid developing material, and the electrical field strength generated between the biased applicator on one surface and the electrostatic latent image on a second surface.

The contact electrostatic printing engines described herein are thus operable for imaging and development of a latent electrostatic image; exemplary toner colors in the respective low solids content liquid developing materials are selectable as known in the art, e.g., cyan, magenta, yellow, and black; however, other component colors may be employed. It is contemplated that a contact electrostatic printing system would employ at least one of the illustrated CEP engines. Furthermore, the liquid developing material operable in the CEP engine may be distinguishable according to one or more physical characteristics in addition to, or other than, the color of the toner, and nonetheless such engines are encompassed by the present invention.

The toner solids or so-called marking particles can comprise any particulate material that is compatible with the liquid carrier medium, such as those contained in the liquid developing materials disclosed in, for example, U.S. Pat. Nos. 3,729,419; 3,841,893; 3,968,044; 4,476,210; 4,707,429; 4,762,764; 4,794,651; and 5,451,483, among others. Preferably, the toner particles should have an average particle diameter ranging from about 0.2 to about 10 microns, and most preferably between about 0.5 and about 2 microns. The toner particles can consist solely of pigment particles, or may comprise a resin and a pigment; a resin and a dye; or a resin, a pigment, and a dye or resin alone.

Suitable resins include poly(ethyl acrylate-co-vinyl pyrrolidone), poly(N-vinyl-2-pyrrolidone), and the like, including, for example Elvax®, and/or Nucrel®, available from E.I. DuPont de Nemours & Co. of Wilmington, Del. Suitable dyes include Orasol Blue 2GLN, Red G, Yellow 2GLN, Blue GN, Blue BLN, Black CN, Brown CR, all available from Ciba-Geigy, Inc., Mississauga, Ontario, Morfast Blue 100, Red 101, Red 104, Yellow 102, Black 101, Black 108, all available from Morton Chemical Company, Ajax, Ontario, Bismark Brown R (Aldrich), Neolan Blue (Ciba-Geigy), Savinyl Yellow RLS, Black RLS, Red 3GLS, Pink GBLS, and the like, all available from Sandoz Company, Mississauga, Ontario, among other manufacturers; as well as the numerous pigments listed and illustrated in U.S. Pat. Nos. 5,223,368; 5,484,670, the disclosures of which are totally incorporated herein by reference. Dyes generally are present in an amount of from about 5 to about 30 percent by weight of the toner particle, although other amounts may be present provided that the objectives of the present invention are achieved.

Suitable pigment materials include carbon blacks such as Microlith® CT, available from BASF, Printex® 140 V, available from Degussa, Raven® 5250 and Raven® 5720, available from Columbian Chemicals Company. Pigment materials may be colored, and may include magenta pigments such as Hostaperm Pink E (American Hoechst Corporation) and Lithol Scarlet (BASF), yellow pigments such as Diarylide Yellow (Dominion Color Company), cyan pigments such as Sudan Blue OS (BASF); as well as the numerous pigments listed and illustrated in U.S. Pat. Nos. 5,223,368; 5,484,670, the disclosures of which are incorporated herein by reference. Generally, any pigment material is suitable provided that it consists of small particles that combine well with any polymeric material also included in the developer composition. Pigment particles are generally present in amounts of from about 5 to about 60 percent by weight of the toner particles, and preferably from about 10 to about 30 percent by weight.

As previously indicated, in addition to the liquid carrier vehicle and toner particles which typically make up the liquid developer materials, a charge director (sometimes referred to as a charge control additive) is also provided for facilitating and maintaining a uniform charge on the marking particles in the operative solution of the liquid developing material by imparting an electrical charge of selected polarity (positive or negative) to the marking particles. Examples of suitable charge director compounds include lecithin, available from Fisher Inc.; OLOA 1200, a polyisobutylene succinimide, available from Chevron Chemical Company; basic barium petronate, available from Witco Inc.; zirconium octoate, available from Nuodex; as well as various forms of aluminum stearate; salts of calcium, manganese, magnesium and zinc; heptanoic acid; salts of barium, aluminum, cobalt, manganese, zinc, cerium, and zirconium octoates and the like. The charge control additive may be present in an amount of from about 0.01 to about 3 percent by weight of solids, and preferably from about 0.02 to about 0.05 percent by weight of solids of the developer composition.

What is claimed is:

1. A toner cake layer delivery apparatus for delivery of a toner cake layer, having a high solids content, to a receiving member surface on a receiving member, comprising:

a supply of liquid developing material, the liquid developing material being a mixture of toner in a carrier fluid, the mixture exhibiting a percentage level of solids content that is less than the percentage level of solids content in the toner cake layer;

a liquid developing material applicator connected to the supply of liquid developing material and operable for receiving a quantity of liquid developing material and for providing therefrom a layer of liquid developing material; and a movable coating member aligned with the liquid developing material applicator and the receiving member, the coating member having a carrier fluid separation surface for receiving thereon the layer of liquid developing material, wherein the carrier fluid separation surface is operable for separating at least a portion of the liquid carrier fluid present in the layer of liquid developing material so as to increase the percentage level of solids content in the layer of liquid developing material, thus providing the toner cake layer, and wherein the coating member is movable for transporting the resulting toner cake layer into engagement with the receiving member surface for subsequent delivery of at least a portion of the toner cake layer to the receiving member surface.

2. The apparatus of claim 1, wherein the low solids content liquid developing material is characterized as having percentage level of solids content in the range of less than approximately 10 percent solids content.

3. The apparatus of claim 1, wherein the toner cake layer is characterized as having at least one of the following characteristics: a percentage level of solids content of approximately 10 percent solids content or greater; a thickness in the range of 1 to 15 microns; and an accurately metered mass per unit area of approximately 0.1 mg per $cm^2$.

4. The apparatus of claim 1, wherein the carrier fluid separation surface further comprises a porous substrate.

5. The apparatus of claim 1, wherein the carrier fluid separation surface further comprises a carrier fluid filter substrate.

6. The apparatus of claim 1, wherein the carrier fluid separation surface further comprises a substrate having a selective affinity for the carrier fluid.

7. An imaging system for effecting contact electrostatic printing of an output image, comprising:

an imaging assembly having an imaging member, the imaging member having an image bearing surface for receiving an electrostatic latent image thereon, the electrostatic latent image being representative of the output image;

a development assembly for developing the electrostatic latent image, the development assembly having a receiving member for receiving a toner cake layer of high solids content and engaging the electrostatic latent image on the image bearing surface for development of the electrostatic latent image member into a developed image representative of the output image; and a toner cake layer delivery apparatus operable for delivery of the toner cake layer to a receiving member surface on the receiving member, the toner cake layer delivery apparatus having: (a) a supply of liquid developing material, the liquid developing material being a mixture of toner in a liquid carrier medium, the mixture exhibiting a percentage level of solids content that is less than the percentage level of solids content in the toner cake layer, (b) a liquid developing material applicator connected to the supply of liquid developing material and operable for receiving a quantity of the liquid developing material and for providing therefrom a layer of liquid developing material, (c) a movable coating member aligned with the liquid developing material applicator and the receiving member, the coating member having a carrier fluid separation surface for receiving thereon the layer of liquid developing material, wherein the carrier fluid separation surface is operable for separating at least a portion of the liquid carrier fluid present in the layer of liquid developing material so as to increase the percentage level of solids content in the layer of liquid developing material, thus providing the toner cake layer, the coating member being movable for transporting the resulting toner cake layer into engagement with the receiving member surface for subsequent delivery of at least a portion of the toner cake layer to the receiving member surface.

8. The imaging system of claim 7, further comprising:

an electrostatic latent image including image areas defined by a first voltage potential and non-image areas defined by a second voltage potential; and a process nip formed by operative engagement of the imaging member and the receiving member for positioning the toner cake layer in pressure contact with the image bearing surface, wherein the electrostatic latent image on the imaging member generates imagewise electric fields across the toner cake layer in the process nip;

wherein the process nip being defined by a nip entrance and a nip exit, and having a pre-established nip gap, the toner cake layer developed in the nip gap to have imagewise separation of the toner cake layer to create a developed image corresponding to the electrostatic latent image and a background image, the developed image and the background image each having a thickness greater than one half the nip gap.

9. The imaging system of claim 8 wherein the toner cake layer is defined by a yield stress threshold in a range sufficient to allow the toner cake layer to behave substantially as a solid at the nip entrance and in the nip gap, while allowing the toner cake layer to behave substantially as a liquid at the nip exit.

10. The imaging system of claim 8, wherein a yield stress threshold of the toner cake layer is sufficient to prevent lateral movement of toner particles therein in presence of one or more compressive stress forces exerted at the nip and nip entrance, and the yield stress threshold is sufficient to permit lateral movement of the toner particles therein in presence of one or more tensile stress forces exerted at the nip exit.

11. The imaging system of claim 7, wherein the image bearing surface includes a photosensitive imaging substrate.

12. The imaging system of claim 7, wherein the low solids content liquid developing material is characterized as having percentage level of solids content in the range of less than approximately 10 percent solids content.

13. Imaging system of claim 7, wherein the toner cake layer is characterized as having at least one of the following characteristics: a percentage level of solids content of approximately 10 percent solids content or greater; a thickness in the range of 1 to 15 microns; and an accurately metered mass per unit area of approximately 0.1 mg per $cm^2$.

14. The imaging system of claim 7, wherein the carrier fluid separation surface further comprises a porous substrate.

15. The imaging system of claim 7, wherein the carrier fluid separation surface further comprises a carrier fluid filter substrate.

16. The imaging system of claim 7, wherein the carrier fluid separation surface further comprises a substrate having a selective affinity for the carrier fluid.

17. An imaging system for effecting contact electrostatic printing of an output image, comprising:

an imaging assembly having an imaging member, the imaging member having an image bearing surface for receiving an electrostatic latent image thereon, the electrostatic latent image being representative of the output image, and for receiving a toner cake layer adjacent the electrostatic latent image on the imaging member;

a charging source for selectively delivering charges to the toner cake layer in an image-wise manner responsive to the electrostatic latent image on the image bearing member to form a secondary latent image in the toner cake layer having image and non-image areas corresponding to the electrostatic latent image on the imaging member;

a development assembly for developing the electrostatic latent image, the development assembly having a separator member for selectively separating at least a portion of the toner cake layer in accordance with the secondary latent image in the toner cake layer to create a developed image corresponding to the electrostatic latent image formed on the image bearing member, so as to develop the electrostatic latent image; and a toner cake layer delivery apparatus operable for delivery of a toner cake layer of high solids content to the image bearing surface on the imaging member, the toner cake layer delivery apparatus having: (a) a supply of liquid developing material, the liquid developing material being a mixture of toner in a liquid carrier medium, the mixture exhibiting a percentage level of solids content that is less than the percentage level of solids content in the toner cake layer, (b) a liquid developing material applicator connected to the supply of liquid developing material and operable for receiving a quantity of liquid developing material and for providing therefrom a layer of liquid developing material, (c) a movable coating member aligned with the liquid developing material applicator and the receiving member, the coating member having a carrier fluid separation surface for receiving thereon the layer of liquid developing material, wherein the carrier fluid separation surface is operable for separating at least a portion of the liquid carrier fluid present in the layer of liquid developing material so as to increase the percentage level of solids content in the layer of liquid developing material, thus providing the toner cake layer, the coating member being movable for transporting the resulting toner cake layer into engagement with the image bearing surface for subsequent delivery of the toner cake layer to the image bearing surface.

18. The imaging system of claim 17, wherein the low solids content liquid developing material is characterized as having percentage level of solids content in the range of approximately 1 to 10 percent solids content.

19. The imaging system of claim 17, wherein the toner cake layer is characterized as having at least one of the following characteristics: a percentage level of solids content of approximately 10 percent solids content or greater; a thickness in the range of 1 to 15 microns; and an accurately metered mass per unit area of approximately 0.1 mg per $cm^2$.

20. The imaging system of claim 17, wherein the carrier fluid separation surface further comprises a porous substrate.

21. The imaging system of claim 17, wherein the carrier fluid separation surface further comprises a carrier fluid filter substrate.

22. The imaging system of claim 17, wherein the carrier fluid separation surface further comprises a substrate having a selective affinity for the carrier fluid.

23. The imaging system of claim 17, further comprising a biased member for inducing air breakdown to create an electrical discharge in the vicinity of the toner cake layer on the latent image, wherein the electrical discharge selectively delivers charged ions to the toner cake layer in response to the electrostatic latent image on the image bearing member to form the secondary latent image in the toner layer.

24. An imaging system for effecting contact electrostatic printing of an output image, comprising:

an imaging assembly having an imaging member, the imaging member having an image bearing surface for receiving a toner cake layer and for receiving an electrostatic latent image thereon, the electrostatic latent image being representative of the output image;

an ionographic device for selectively altering a uniform charge on the image bearing surface in an image-wise manner responsive to the electrostatic latent image;

a development assembly for developing the electrostatic latent image, the development assembly having a separator member for selectively separating at least a portion of the toner cake layer from the imaging member in accordance with the latent image in the toner cake layer to create a developed image corresponding to the electrostatic latent image, so as to develop the electrostatic latent image; and a toner cake layer delivery apparatus operable for delivery of the toner cake layer to the image bearing surface, the toner cake layer delivery apparatus having: (a) a supply of liquid developing material, the liquid developing material being a mixture of toner in a liquid carrier medium, the mixture exhibiting a percentage level of solids content that is less than the percentage level of solids content in the toner cake layer, (b) a liquid developing material applicator connected to the supply of liquid developing material and operable for receiving a quantity of the liquid developing material and for providing therefrom a layer of liquid developing material, (c) a movable coating member aligned with the liquid developing material applicator and the receiving member, the coating member having a carrier fluid separation surface for receiving thereon the layer of liquid developing material, wherein the carrier fluid separation surface is operable for separating at least a portion of the liquid carrier fluid present in the layer of liquid developing material so as to increase the percentage level of solids content in the layer of liquid developing material, thus providing the toner cake layer, the coating member being movable for transporting the resulting toner cake layer into engagement with the image bearing surface for subsequent delivery of the toner cake layer to the image bearing surface.

25. The imaging system of claim 24, wherein the low solids content liquid developing material is characterized as having percentage level of solids content in the range of approximately 1 to 10 percent solids content.

26. The imaging system of claim 24, wherein the toner cake layer is characterized as having at least one of the following characteristics: a percentage level of solids content of approximately 10 percent solids content or greater; a thickness in the range of 1 to 15 microns; and an accurately metered mass per unit area of approximately 0.1 mg per $cm^2$.

27. The imaging system of claim 24, wherein the carrier fluid separation surface further comprises a porous substrate.

28. The imaging system of claim 24, wherein the carrier fluid separation surface further comprises a carrier fluid filter substrate.

29. The imaging system of claim 24, wherein the carrier fluid separation surface further comprises a substrate having a selective affinity for the carrier fluid.

30. An imaging system for effecting contact electrostatic printing of an output image on a copy substrate, comprising:

a toner cake layer delivery apparatus having: (a) a supply of liquid developing material, the liquid developing material being a mixture of toner in a liquid carrier medium, the mixture exhibiting a percentage level of solids content that is less than the percentage level of solids content in a desired toner cake layer, (b) a liquid developing material applicator connected to the supply of liquid developing material and operable for receiving a quantity of the liquid developing material and for providing therefrom a layer of liquid developing material, (c) a movable coating member aligned with the liquid developing material applicator, the coating member having a conductive carrier fluid separation surface for receiving thereon the layer of liquid developing material, wherein the carrier fluid separation surface is operable for separating at least a portion of the liquid carrier fluid present in the layer of liquid developing material so as to increase the percentage level of solids content in the layer of liquid developing material, thus providing the toner cake layer;

an ionographic device for selectively charging the toner cake layer in an image-wise manner to provide an electrostatic latent image; and a transfer assembly for transporting the portion of the toner cake layer that bears the latent image into engagement with the copy substrate and for selectively separating at least a portion of the toner cake layer from the coating member in accordance with the latent image so as to form a developed image, and for transferring the developed image to the copy substrate.

31. The imaging system of claim 30, wherein the low solids content liquid developing material is characterized as having percentage level of solids content in the range of approximately 1 to 10 percent solids content.

32. The imaging system of claim 30, wherein the toner cake layer is characterized as having at least one of the following characteristics: a percentage level of solids content of approximately 10 percent solids content or greater; a thickness in the range of 1 to 15 microns; and an accurately metered mass per unit area of approximately 0.1 mg per $cm^2$.

33. The imaging system of claim 30, wherein the carrier fluid separation surface further comprises a porous substrate.

34. The imaging system of claim 30, wherein the carrier fluid separation surface further comprises a carrier fluid filter substrate.

35. The imaging system of claim 30, wherein the carrier fluid separation surface further comprises a substrate having a selective affinity for the carrier fluid.

36. A method for delivery of a toner cake layer of high solids content to a receiving member surface on a receiving member, the receiving member being operable in a development apparatus in a contact electrostatic printing engine, comprising the steps of:

providing a supply of liquid developing material, the liquid developing material being a mixture of toner in a liquid carrier medium, the mixture exhibiting a percentage level of solids content that is less than the percentage level of solids content in the toner cake layer;

applying a quantity of liquid developing material drawn from the supply of liquid developing material to a carrier fluid separation surface on a coating member, so as to form a layer of liquid developing material on the surface of the coating member and so as to separate at least a portion of the liquid carrier medium present in the layer of liquid developing material on the surface of the coating member, whereby the percentage level of solids content in the layer of liquid developing material is increased, thus providing the toner cake layer;

engaging at least a portion of the carrier fluid separation surface that bears the toner cake layer with the receiving member surface; and transferring at least a portion of the toner cake layer from the surface of the coating member to the receiving member surface.

* * * * *